United States Patent [19]

Schoppee

[11] 4,084,509

[45] Apr. 18, 1978

[54] APPARATUS FOR PRINTING ON AN ADVANCING WEB

[75] Inventor: Lawrence W. Schoppee, Springfield, Mass.

[73] Assignee: Package Machinery Company, East Longmeadow, Mass.

[21] Appl. No.: 724,861

[22] Filed: Sep. 20, 1976

[51] Int. Cl.[2] ..... B41F 3/54; B41F 3/64; B41F 3/44

[52] U.S. Cl. ..... 101/261; 101/278; 101/228

[58] Field of Search ..... 101/260, 270, 253, 259, 101/261, 266, 269, 291, 228, 219, 216, 214, 212, 277, 278, 292; 74/390

[56] References Cited

U.S. PATENT DOCUMENTS

| | | | |
|---|---|---|---|
| 876,132 | 1/1908 | Bechman | 101/260 |
| 2,624,278 | 1/1953 | Robbins | 101/253 |
| 2,705,453 | 4/1955 | Nield | 101/292 |
| 2,771,837 | 11/1956 | Federwitz | 101/228 |
| 3,183,834 | 5/1965 | Marmor et al. | 101/260 |
| 3,590,313 | 6/1971 | Stoke | 74/390 |
| 3,610,147 | 10/1971 | Crissy et al. | 101/228 |

*Primary Examiner*—Edgar S. Burr
*Assistant Examiner*—William Pieprz
*Attorney, Agent, or Firm*—McCormick, Paulding & Huber

[57] ABSTRACT

Apparatus for cyclically printing information on a moving web utilizes a stationary printing head at a printing station along the path traversed by the moving web and a roller which guides the web and sweeps the web across the printing head in the direction opposite to web advancement so that there is substantially no relative movement between the web and head as printing occurs. The roller is supported for sweeping movement back and forth over the printing head by means of a pivotal linkage driven by a crank which causes the guided web to engage the head during a sweep in one direction only. A cyclic drive for the linkage includes an eccentric gear set to modulate the speeds of the roller and web.

6 Claims, 6 Drawing Figures

APPARATUS FOR PRINTING ON AN ADVANCING WEB

BACKGROUND OF THE INVENTION

The present invention relates to printing equipment and is concerned more particularly with equipment for line printing along a continuously moving web of sheet material at regularly spaced intervals.

In many packaging operations, a web of sheet material is cut in sections which are utilized as the wrappers or labels on the exterior of sealed packages. Frequently it is desirable to place identifying codes or other information on the wrapper but such information must be printed on the web during the wrapping or labeling operation. For example, lot numbers or date codes on packages containing food stuffs and other perishable materials determine when the products were packaged or when the contents will no longer be suitable for consumption or use. It is usually not possible to determine in advance when a particular label or wrapper will be applied to a package and therefore, pre-printing the labels with the identifying codes is not feasible.

For these reasons code dating equipment is employed within a packaging machine and frequently operates on a moving web of wrapping material as the web is drawn through the machine and applied to packages during wrapping or labeling operations. One such dater is disclosed in co-pending application Ser. No. 607,665 entitled HIGH SPEED PRINTER and filed on Aug. 25, 1975 by Lawrence W. Schoppee. The coder dater in the co-pending application utilizes a series of web guiding rollers at the printing station which rollers are operated in synchronism by a cyclic drive mechanism. In certain packaging machines, a less complex printing mechanism is desired.

It is, accordingly, a general object of the present invention to provide a simplified apparatus for printing information cyclically on a web of moving sheet material as the web advances through a machine at a printing station.

SUMMARY OF THE INVENTION

The present invention resides in an apparatus for cyclically printing information at spaced intervals on a continuously advancing web of sheet material. The apparatus employs a printer situated at a printing station adjacent the advancing web and has a printing head facing a broad side of the web. For example, the printing head may be comprised of a series of rotatable wheels having printing characters disposed about their periphery so that various combinations of offset characters can be positioned in a line engageable with the moving web.

A web guiding roller is supported at the printing station adjacent the printing head for free rotation about its own axis to guide the advancing web through the station. A first movable link supports the roller with the advancing web thereon for motion back and forth over the printing head in a plane generally perpendicular to the axis of the roller. The movable link is itself supported on a shiftable pivot having an axis parallel to the roller axis and is shifted cyclically with the roller during a printing operation to periodically press the web into engagement with the printing head.

Cyclic drive means are connected to the link for shifting the link and the roller relative to the printing head and also for causing tilting of the link about the shiftable pivot. Such reciprocation and tilting is coordinated to sweep the roller and web over the printing head in one direction opposite web advancement with the web in contact with the head, and to return the web and roller in the reverse direction with the advancing web out of contact with the head. Such motions cause the relative speed between the web and head to be reduced to zero when the web is in contact with the printing head and allow the web to advance past the printing head when the web and head are out of contact. The cyclic drive means also includes an eccentric gear set to modulate the speeds of the roller and web.

The apparatus is relatively simple in operation and can be adjusted to match various web advancement speeds with the printing speeds to generate clear code dates or other lines of print at spaced intervals on the advancing web.

DESCRIPTION OF THE PREFERRED EMBODIMENTS

Figure 1:
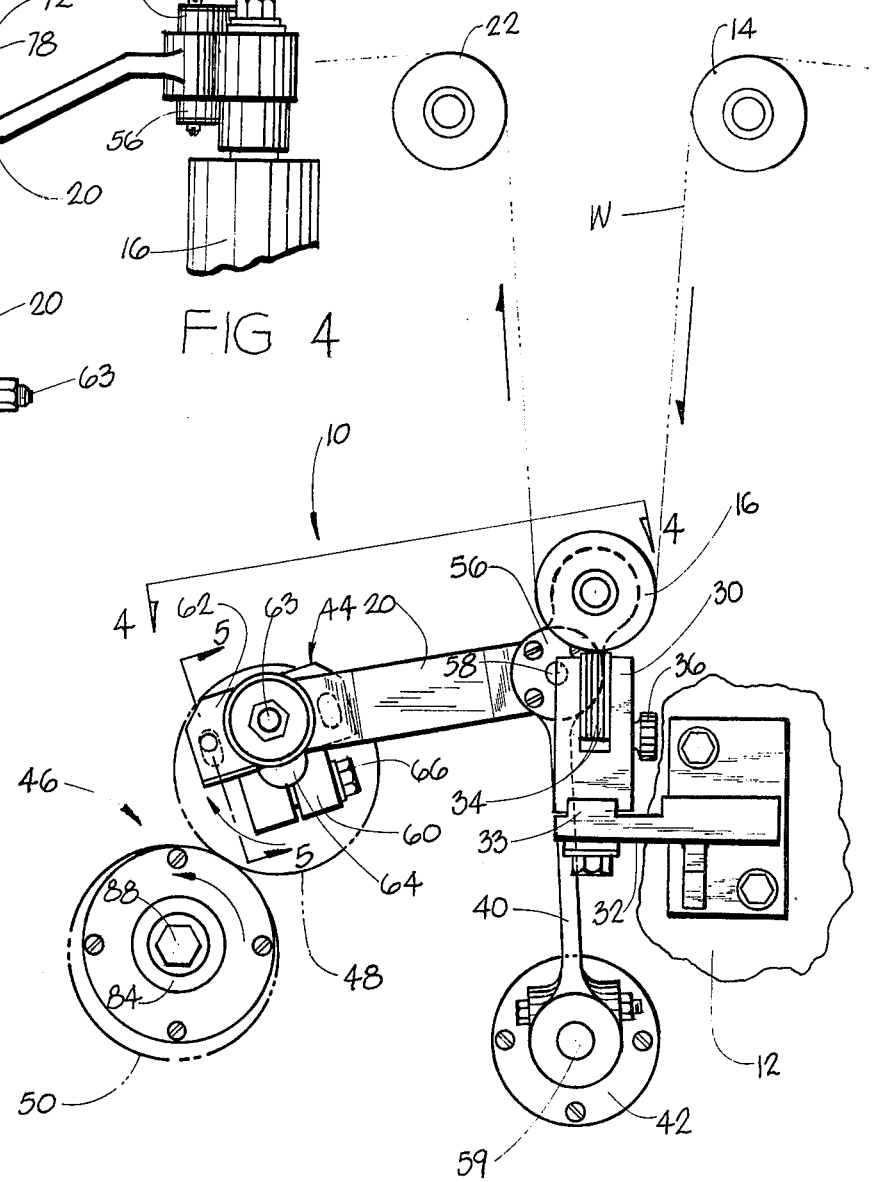
FIG. 1 is a front elevation view of the printing apparatus of the present invention and shows the manner in which the web of sheet material is guided relative to a printing station.
Figure 2:
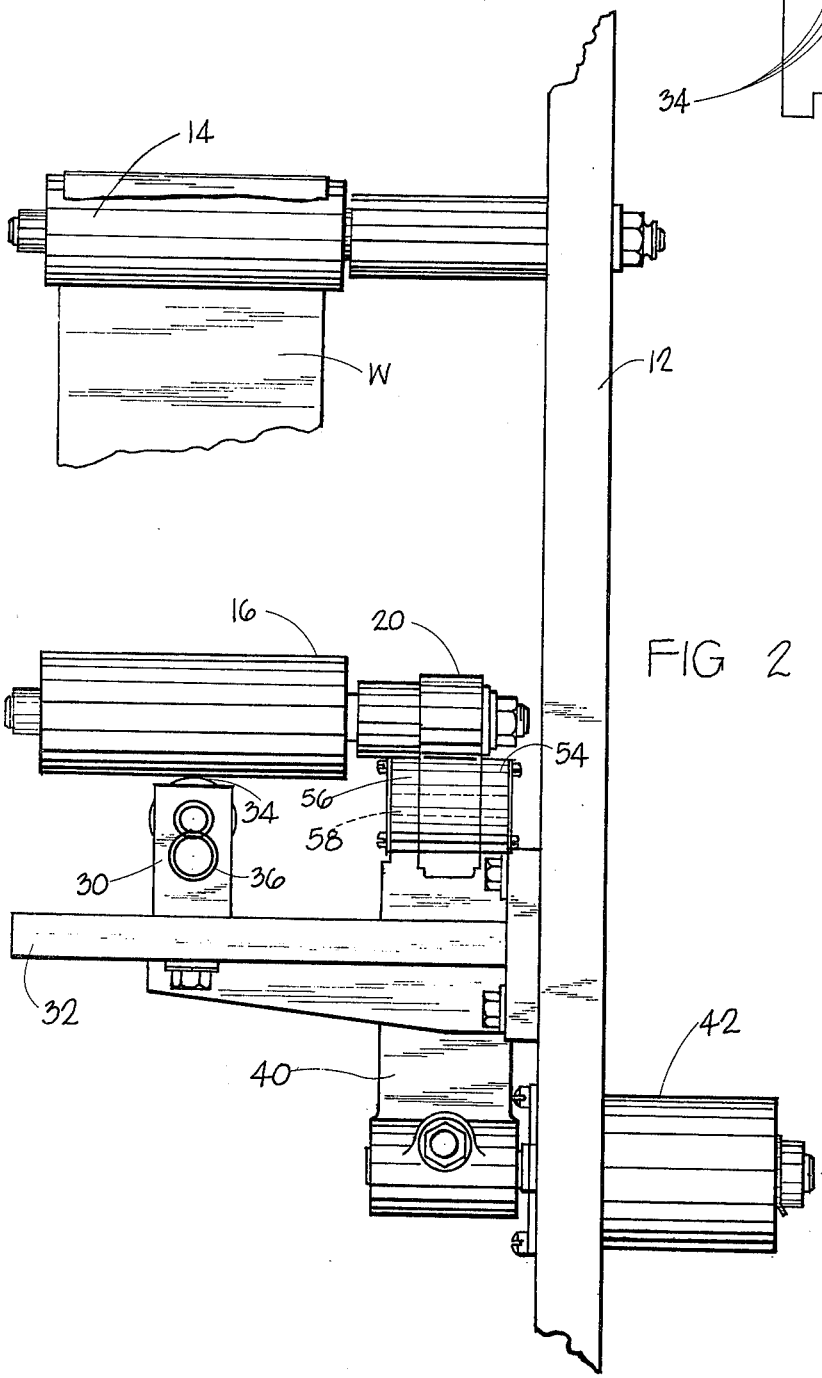
FIG. 2 is a side elevation of the printing apparatus as viewed from the right in FIG. 1.

FIGS. 1 and 2 illustrate the principal components of the printing apparatus, generally designated 10, for line printing on the broad side of the web at regularly spaced intervals. The apparatus 10 is mounted to a frame or partition 12 of a wrapping machine through which the web W is transported in a wrapping operation. The web movement to and from the printing station is continuous and in the direction indicated by the arrows during a wrapping operation. Accordingly, the web enters the printing station over a stationary guide roller 14 attached to the partition 12, advances in a loop around a movable guide roller 16 supported at one end of an L-shaped link 20 and then leaves the printing station over another stationary guide roller 22 attached to the partition 12.

At the printing station, a printing head 30 is fixedly mounted to the partition 12 by means of a cantilevered bracket 32. The bracket may be provided with a slotted track 33 extending parallel to the roller 16 in order to situate the printing head at various axial stations along the roller and make contact with selected regions across the broad side of the web. The printing head includes a plurality of printing wheels 34 that are individually rotatable relative to one another and which bear on their periphery a number of raised printing characters. Each of the printing wheels 34 is engaged with the thumb knob 24 in order to hold selected characters on the several wheels stationary in a line of print that is engaged by the web W as the roller 16 rolls across the tops of the wheels in a plane perpendicular to the axis of the roller. The roller 16 has a resilient exterior which presses the web against the raised printing characters on the wheels 34 and embosses the characters in the web in a dry printing process. The embossed information, for example, could be a code date or lot number identifying the products being packaged.

The linkage mechanism which sweeps the roller 16 and web cyclically back and forth over the printing head 30 includes the L-shaped link 20, a rocker arm 40 pivotally connected at one end to the link and pivotally mounted at the opposite end on an eccentric 59 adjustably positionable with the housing 42, a rotatably driven crank 44 and a cyclic drive mechanism 46 including a set of eccentric drive gears 48 and 50.

The upper end of the rocker arm 40 has a bifurcation 54 and 56 through which a pivot pin 58 engages the link 20 to establish a pivot point between the roller 16 at one end of the link and the crank 44 connected to the opposite end of the link. The lower end of the rocker arm 40 is supported on the eccentric 59 for rocking motion. The position of the eccentric 59 can be adjusted within limits by rotating the eccentric within the arm 40, and the printing pressure between the web and wheels 34 is correspondingly adjusted.

Figure 4:
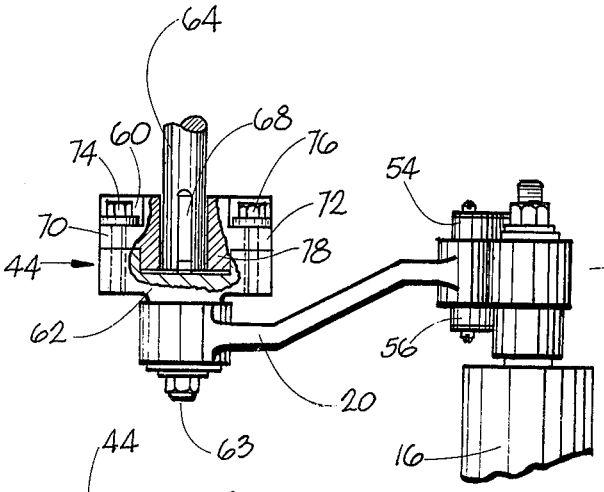
FIG. 4 is a fragmentary view showing a portion of the printer in FIG. 1 from above. p

The crank 44 is an adjustable crank comprised of an arm 60 and a slide 62 carrying the crank pin 63 at the swinging end of the crank. The arms 60 is secured for rotation to a drive shaft 64 by means of a clamping bolt 66 and a key 68 interposed between the drive shaft 64 and the arm. The radially outer end of the arm 60 includes two ears 70 and 72 extending toward opposite lateral sides of the crank and the ears contain oblong slots in which clamping bolts 74 and 76 may be adjusted. Between the ears 70 and 72 the arm 60 has a projecting track 78 as shown in FIG. 4 which extends radially along the arm, and the slide 62 includes a corresponding cutout which engages the track so that the slide may be adjusted radially on the arm to any desired position. The clamping bolts 74 and 76 extend through the slots in the ears 70 and 72 into the slide and are permitted to move radially along the arm 60 with the slide 62 to adjust the radial distance between the axis of drive shaft 64 and the crank pin 63 on which the one end of the link 20 is mounted. Thus by loosening the bolts 74 and 76 and positioning the slide 62, the radial dimension of the crank 44 and, correspondingly, the throw of the roller 16 which results when the crank 44 is driven through a complete revolution by the drive shaft 64, can be adjusted.

Figure 3:
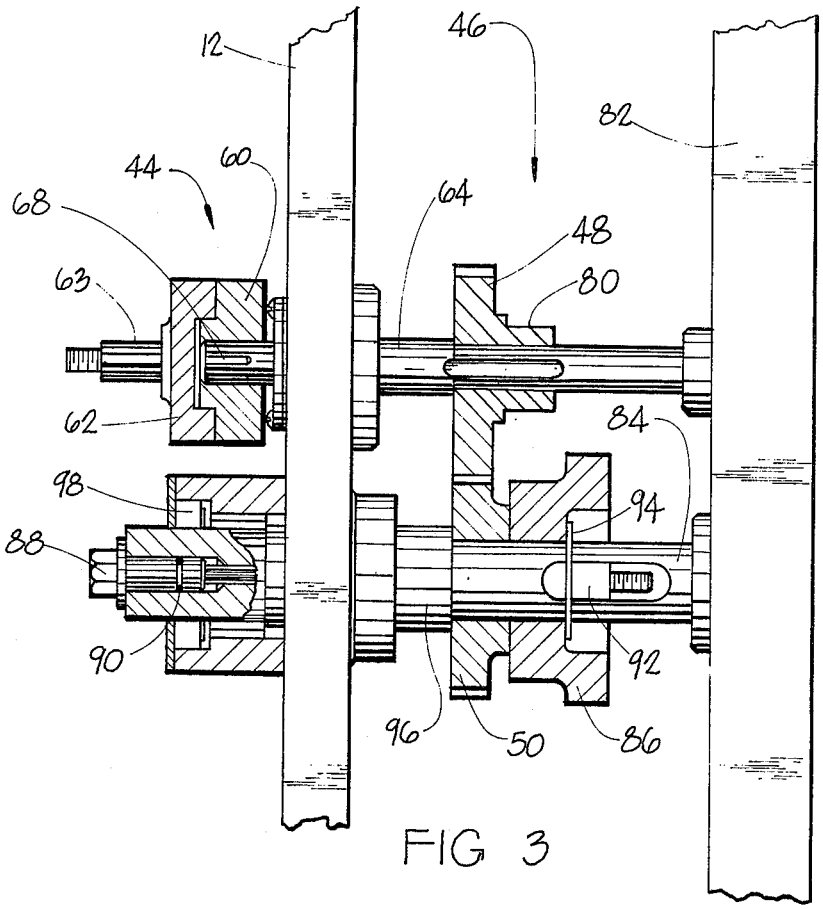
FIG. 3 is a partially sectioned view of the cyclic drive mechanism for operating the apparatus in FIGS. 1 and 2.

FIG. 3 illustrates the cyclic drive mechanism 46 which includes the eccentric gears 48 and 50. The drive shaft 64 on which the crank 44 is mounted extends through a transmission housing defined at one side by the partition 12 and on the other side by a casing 82. The gear 48 is fixedly secured to the drive shaft 64 through its hub 80. Another drive shaft 84 also extends through the housing between the partition 12 and casing 82 parallel with the drive shaft 64 and supports the other eccentric gear 50. A drive gear 86 mounted on the shaft 84 is driven by other gears and a drive motor (not shown) outside of the housing and serves as a clamping member for fixing the eccentric gear 50 to the shaft 84. For this purpose, an adjusting bolt 88 exposed at one end of the drive shaft 84 extends through an oil seal 90 to a clamping block 92 situated in and projecting from an axial slot in the drive shaft 84. The block 92 engages a washer 94 mounted on the exterior of the drive shaft 84 and when the bolt 88 is tightened the washer presses the gear 86 against the eccentric gear 50 and thus clamps the gear to the shaft 84 against the shoulder 96. Another oil seal 98 surrounds the drive shaft 84 at the exterior side of the partition 12 to permit an oil bath or spray to be directed against the eccentric gears 48 and 50 during operation of the printing apparatus.

OPERATION

Figure 6:
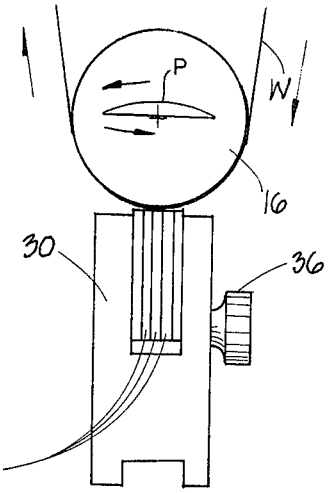
FIG. 6 is a detailed view of the web guide roller and printing head and, illustrates the path of movement of the roller relative to the head.

It will be apparent in FIG. 1 that the crank 44 causes the link 20 to move the pressing roller 16 to the right when the crank is in the position illustrated and the eccentric gears 48 and 50 are rotated in the direction indicated by the arrows. After the crank 44 has rotated through 180° from the illustrated position, the pressing roller 16 is moving to the left but is also elevated slightly due to the tilting of the L-shaped link 20 between the bifurcation 54 and 56 at the upper end of the rocker arm 40. Continued rotation of the crank moves the pressing roller 16 further to the left and then back to the position illustrated. FIG. 6 illustrates the relatively flat orbital path P which the center of the roller 16 tracks during a single revolution of the crank 44. It will be noted that the path followed as the roller moves to the right is substantially straight which develops a relatively uniform pressure between the printing wheels 34 and the web W while the web is held in engagement with the wheels. When the roller 16 moves to the left, the roller is elevated slightly to insure that no contact exists between the web and printing wheels. The vertical motion of the wheel is limited to avoid the introduction of substantial slack in the web.

In order to generate a clear image on the web W during the printing operation, the speed of the roller motion to the right in FIGS. 1 and 6 is adjusted to match the speed of advancement of the web in the opposite direction or to the left, and thus, the net velocity of the web relative to the printing head 30 is zero while the web is in contact with the printing wheels 34. To adjust the roller velocity for this result, the radius of the crank 44 is adjusted by moving the slide 62 radially in or out on the arm 60 while the clamping bolts 74 and 76 are loose. It should also be noted that the eccentric gears 48 and 50 are phased with the rotation of the crank 44 to modulate the rotational velocity of the crank and correspondingly the horizontal velocity of the roller 16 for a relatively constant speed while the web is in contact with the printing wheels and a maximum speed during the return stroke. After the gear phasing and dimension of the crank 44 have been adjusted, the eccentric 59 is utilized to adjust the position of rocker arm 40 so that the roller 16 develops appropriate pressure between the web and the printing wheels 34.

Since the printed information is generally desired at a specified location along the advancing web W, it is also necessary to adjust the cyclic operation of the printing apparatus with respect to the position of the advancing web. The clamping bolt 88 and drive gear 86 in FIG. 3 cooperate with the eccentric gear 50 to make such adjustment. By loosening the bolt 88 and rotating the crank 44 together with the eccentric gears 48 and 50 relative to the drive gear 86, a correspondence between the phasing of the printing roller 16 and the position of the web within the machine can be brought about whether the drive mechanism for the web and drive gear 86 are the same mechanism or are two different synchronized mechanisms.

Accordingly, a printing apparatus has been disclosed for cyclically generating printed information at spaced intervals along an advancing web of sheet material. The apparatus utilizes a linkage mechanism to oscillate the printing roller back and forth over a stationary printing head and synchronizes the speed of the roller with the advancing movement of the web to produce a clear image during the printing operation.

While the present invention has been described in a preferred embodiment, it will be understood that numerous modifications and substitutions can be had without departing from the spirit of the invention. For example, it is not essential to utilize an adjustable crank in the linkage mechanism if it is possible to establish in advance the precise dimension of the crank which is necessary to synchronize the speed of the roller 16 with the advancing movement of the web W. The precise configuration of the linkages illustrated may be varied in order to suit the particular environment in which the printing apparatus is utilized. The printing head may also take forms other than that illustrated. Accordingly, the present invention has been described in a preferred embodiment by way of illustration rather than limitation.

I claim:

1. Apparatus for cyclically printing information at spaced intervals on a continuously advancing web of the sheet material comprising:

a printer situated at a printing station adjacent to the advancing web and having a printing head facing a broad side of the web for producing printed information on the broad side;

a web guide roller supported at the printing station adjacent the printing head for free rotation about its own axis to guide the advancing web through the station;

a linkage including a rocker arm mounted at one end for rocking motion about a given axis and pivotally connected at the opposite end with a movable link to provide a shiftable pivot axis for the link at said opposite end of the rocker arm, the rocking motion of the arm about the given axis at said one end being accomadated by shifting of the pivot axis for the link at said opposite end the movable link supporting the roller with the advancing web guided thereon for shifting motion back and forth over the printing head with the shiftable pivot axis parallel to the axis of the roller; and drive means connected to the linkage for cyclically rocking the arm, shifting the pivot axis for the link and moving the link and roller back and forth relative to the printing head and also simultaneously tilting the link about the shiftable pivot axis to sweep the roller and web over the printing head in one direction opposite the direction of web advancement with the web in contact with the head and to return the web and roller in the reverse direction with the advancing web out of contact with the head.

2. Apparatus for cyclically printing on a continuously advancing web as defined in claim 1 wherein the drive means shifts the link, roller and web in the one direction opposite the web advancement at substantially the same speed as the web advancement whereby the instantaneous velocity of the web at the printing head is approximately zero.

3. Apparatus for cyclically printing on a continuously moving web as defined in claim 2 wherein:

the web-guiding roller is mounted at one end of the link;

the linkage includes a rotatably driven crank connected to the movable link; and the drive means is connected to the link at the end opposite said one end and the web-guide roller, and includes a cyclic gear set having a variable gear ratio connected to the crank for driving the crank rotationally at a cyclically variable speed.

4. Apparatus for cyclically printing on a continuously moving web as defined in claim 3 wherein the cyclically variable gear set and the rotatably driven crank connected with the gear set are interconnected and connected in driving relationship with the movable link to sweep the roller and guided web over the printing head at one speed in the direction opposite web advancement with the web in rolling contact with the head and return the web and roller at a higher speed in the reverse direction with the web out of contact with the head.

5. Apparatus for cyclically printing on a continuously advancing web as defined in claim 3 wherein:

the crank is connected to the end of the link opposite from the roller; and the rocker arm is connected to the link intermediate the roller and the crank of the drive means

6. An apparatus for line printing along a web of sheet material at regularly spaced intervals during continuously driven advance of the web around a non-driven but rotatable roller, the apparatus including a printing device adapted to engage the web while on the roller with its printing line substantially tangential to the roller, an L-shaped link rotatably supporting the roller at the end of the link, a crank rotatable about one end and having its opposite swinging end connected to the other end of the arm pivotally supported at one end and having its other end pivotally connected to the link between the ends of the link whereby to permit cyclic movement of the roller forward-and-back across the printing line of the printing device, and a cyclic drive for the crank adapted to move the link so that the roller moves forwardly across the printing line in the plane of tangency between the roller and printing line at substantially the speed of but in opposite direction to the advance of the web during one-half cycle and then moves the roller back while out of the said plane of tangency during the remaining half cycle.

* * * * *

UNITED STATES PATENT OFFICE

CERTIFICATE OF CORRECTION

Patent No. 4,084,509 Dated April 18, 1978

Inventor(s) Lawrence W. Schoppee

Figure 5:
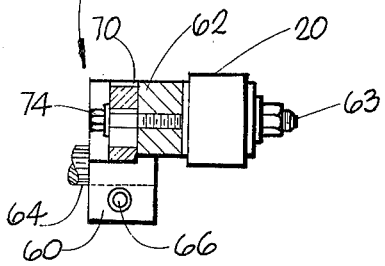
FIG. 5 is a partially sectioned view of the cyclic drive mechanism as seen along the sectioning line 5—5 in FIG. 1.

It is certified that error appears in the above-identified patent and that said Letters Patent are hereby corrected as shown below:

Col. 2, Line 31 after "above ." delete "p"; and
Fig. 5 should be a new paragraph.

Col. 5, line 28 before "sheet material" delete "the".

Col. 5, line 44 "accomadated" should be --accommodated--.

Col. 6, line 36 after "means" insert --.--.

Col. 6, line 46 after "end of the " insert --link, an--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*